US010495432B2

(12) United States Patent
Halander et al.

(10) Patent No.: US 10,495,432 B2
(45) Date of Patent: Dec. 3, 2019

(54) SYSTEMS FOR DELIVERING EXPLOSIVES AND METHODS RELATED THERETO

(71) Applicant: Dyno Nobel Inc., Salt Lake City, UT (US)

(72) Inventors: John B. Halander, Salt Lake City, UT (US); Cornelis L. Kome, Salt Lake City, UT (US); Casey L. Nelson, Murray, UT (US); Jon Bruner, Draper, UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 0 days.

(21) Appl. No.: 15/581,411

(22) Filed: Apr. 28, 2017

(65) Prior Publication Data

US 2017/0227341 A1 Aug. 10, 2017

Related U.S. Application Data

(60) Division of application No. 14/618,231, filed on Feb. 10, 2015, now Pat. No. 9,638,505, which is a continuation of application No. 13/909,818, filed on Jun. 4, 2013, now Pat. No. 9,207,055.

(60) Provisional application No. 61/762,149, filed on Feb. 7, 2013.

(51) Int. Cl.
*F42D 1/10* (2006.01)
*F42D 3/04* (2006.01)

(52) U.S. Cl.
CPC ..... *F42D 1/10* (2013.01); *F42D 3/04* (2013.01)

(58) Field of Classification Search
CPC ..... F42D 1/04; F42D 1/08; F42D 1/10; F42D 3/04; F42D 99/00
USPC ..... 102/301, 313
See application file for complete search history.

(56) References Cited

U.S. PATENT DOCUMENTS

| | | | | |
|---|---|---|---|---|
| 2,745,346 | A | | 5/1953 | Aitchison et al. |
| 3,482,640 | A | | 12/1969 | Browning |
| 3,582,411 | A | | 6/1971 | Brockbank et al. |
| 3,617,401 | A | | 11/1971 | Mortensen et al. |
| 4,189,185 | A | | 2/1980 | Kammerer, Jr. et al. |
| 4,585,496 | A | | 4/1986 | Honeyman et al. |
| 4,615,752 | A | | 10/1986 | Miller |
| 4,737,207 | A | | 4/1988 | Ehrnstrom et al. |
| 4,966,077 | A | | 10/1990 | Halliday et al. |
| 5,099,763 | A | * | 3/1992 | Coursen ..... C06B 45/00 102/313 |
| 5,524,523 | A | | 6/1996 | Lubbe et al. |
| 6,113,715 | A | | 9/2000 | Halander et al. |

(Continued)

FOREIGN PATENT DOCUMENTS

| | | |
|---|---|---|
| EP | 0194774 | 9/1986 |
| EP | 0612971 | 8/1994 |

(Continued)

OTHER PUBLICATIONS

European Search Report dated Aug. 19, 2016 for EP13874262.2.

(Continued)

*Primary Examiner* — James S Bergin
(74) *Attorney, Agent, or Firm* — Stoel Rives LLP

(57) ABSTRACT

Systems for delivering explosives with variable densities are disclosed herein. Methods of delivering explosives with variable densities and methods of varying the energy of explosives in a blasthole are disclosed herein.

18 Claims, 5 Drawing Sheets

(56) References Cited

U.S. PATENT DOCUMENTS

| | | | |
|---|---|---|---|
| 6,165,297 | A | 12/2000 | Smith et al. |
| 6,397,719 | B1 | 6/2002 | Vestre |
| 6,397,754 | B1 | 6/2002 | Perlid |
| 6,397,784 | B1 | 6/2002 | Morgan-Albertson et al. |
| 6,537,399 | B2 | 3/2003 | Gomez De Segura et al. |
| 6,610,158 | B2 | 8/2003 | Lanza Rivas et al. |
| 6,712,144 | B2 | 3/2004 | Buyaert |
| 6,982,015 | B2 * | 1/2006 | Atkinson ..... C06B 47/00 149/109.6 |
| 7,483,805 | B2 | 1/2009 | Sparks et al. |
| 7,527,095 | B2 | 5/2009 | Bloess et al. |
| 7,771,550 | B2 | 8/2010 | Halander et al. |
| 8,037,950 | B2 | 10/2011 | Tibbitts et al. |
| 8,114,231 | B2 | 2/2012 | Da Silva et al. |
| 8,186,456 | B2 | 5/2012 | Tibbitts et al. |
| 8,682,589 | B2 | 3/2014 | Thigpen et al. |
| 8,826,820 | B2 * | 9/2014 | Brent ..... F42D 1/055 102/312 |
| 9,207,055 | B2 | 12/2015 | Halander et al. |
| 9,435,625 | B2 | 9/2016 | Halander et al. |
| 9,638,505 | B2 * | 5/2017 | Halander ..... F42D 3/04 |
| 2002/0023754 | A1 | 2/2002 | Buytaert |
| 2002/0124918 | A1 | 9/2002 | Beitia Gomez De Segura et al. |
| 2009/0250225 | A1 | 10/2009 | Zaeper et al. |
| 2011/0220416 | A1 | 9/2011 | Rives |
| 2012/0037426 | A1 | 2/2012 | Ritchie et al. |
| 2012/0118644 | A1 | 5/2012 | Vandenbulcke |
| 2012/0205155 | A1 | 8/2012 | Tibbitts et al. |
| 2012/0205156 | A1 | 8/2012 | Tibbitts et al. |
| 2013/0152812 | A1 | 6/2013 | Brent et al. |
| 2015/0168116 | A1 | 6/2015 | Halander et al. |
| 2016/0145165 | A1 | 5/2016 | Zank et al. |
| 2016/0146587 | A1 | 5/2016 | Zank et al. |

FOREIGN PATENT DOCUMENTS

| | | | |
|---|---|---|---|
| RU | 2232976 | | 7/2004 |
| RU | 2316529 | | 2/2008 |
| RU | 116493 | | 5/2012 |
| RU | 121174 | | 10/2012 |
| WO | 199409244 | | 4/1994 |
| WO | 199945337 | | 9/1999 |
| WO | 200078694 | | 12/2000 |
| WO | 2003055830 | | 7/2003 |
| WO | 2008026124 | A2 | 3/2008 |
| WO | 2014123562 | A | 8/2014 |

OTHER PUBLICATIONS

Mighty Mobile Manufacturing Units on the Move, http://www.aelminingservices.com/news-feeds/news/287-mighty-mobile-manufacturing, Oct. 2, 2012.

U.S. Appl. No. 13/909,818, et al., Notice of Allowance ,dated Aug. 14, 2015 ,10 pages.

U.S. Appl. No. 13/909,818, et al., Office Action ,dated Jan. 26, 2015.

U.S. Appl. No. 13/909,818, et al., Restriction/Election Requirement, dated Jul. 21, 2014.

U.S. Appl. No. 14/618,231, et al., Notice of Allowance ,dated Dec. 23, 2016 ,23 pages.

U.S. Appl. No. 14/962,770, et al., Non-Final Office Action ,dated Feb. 12, 2016.

U.S. Appl. No. 14/962,770, et al., Notice of Allowance ,dated Jul. 7, 2016 ,6 pages.

Desai, et al.,Underreaming: Old Method with New Technology, SPE/IADC Drilling Conference, New Orleans, LA http://www.onepetro.org/mslib/servlet/onepetropreview?id=00018693, Feb. 28, 1989.

PCT/US2013/044082, et al., International Preliminary Report on Patentability ,dated Aug. 20, 2015.

PCT/US2013/044082, et al., International Search Report and Written Opinion ,dated Mar. 20, 2014.

* cited by examiner

SYSTEMS FOR DELIVERING EXPLOSIVES AND METHODS RELATED THERETO

CROSS-REFERENCE TO RELATED APPLICATIONS

This application is a divisional of U.S. patent application Ser. No. 14/618,231, entitled "SYSTEMS FOR DELIVERING EXPLOSIVES AND METHODS RELATED THERETO," filed Feb. 10, 2015, which is a continuation of U.S. Pat. No. 9,207,055, entitled "SYSTEMS FOR DELIVERING EXPLOSIVES AND METHODS RELATED THERETO," issued Dec. 8, 2015 and filed Jun. 4, 2013, which under 35 U.S.C. § 119(e), claimed the benefit of U.S. Provisional Patent Application No. 61/762,149, entitled "SYSTEMS FOR DELIVERING EXPLOSIVES AND METHODS RELATED THERETO," filed Feb. 7, 2013, the contents of all of which are hereby incorporated herein by reference in their entirety.

TECHNICAL FIELD

The present disclosure relates generally to explosives. More specifically, the present disclosure relates to systems for delivering explosives and methods related thereto. In some embodiments, the methods relate to methods of varying the explosive energy of explosives in a blasthole.

BRIEF DESCRIPTION OF THE DRAWINGS

The embodiments disclosed herein will become more fully apparent from the following description and appended claims, taken in conjunction with the accompanying drawings. The drawings depict primarily generalized embodiments, which embodiments will be described with additional specificity and detail in connection with the drawings in which:

DETAILED DESCRIPTION

Figure 1:
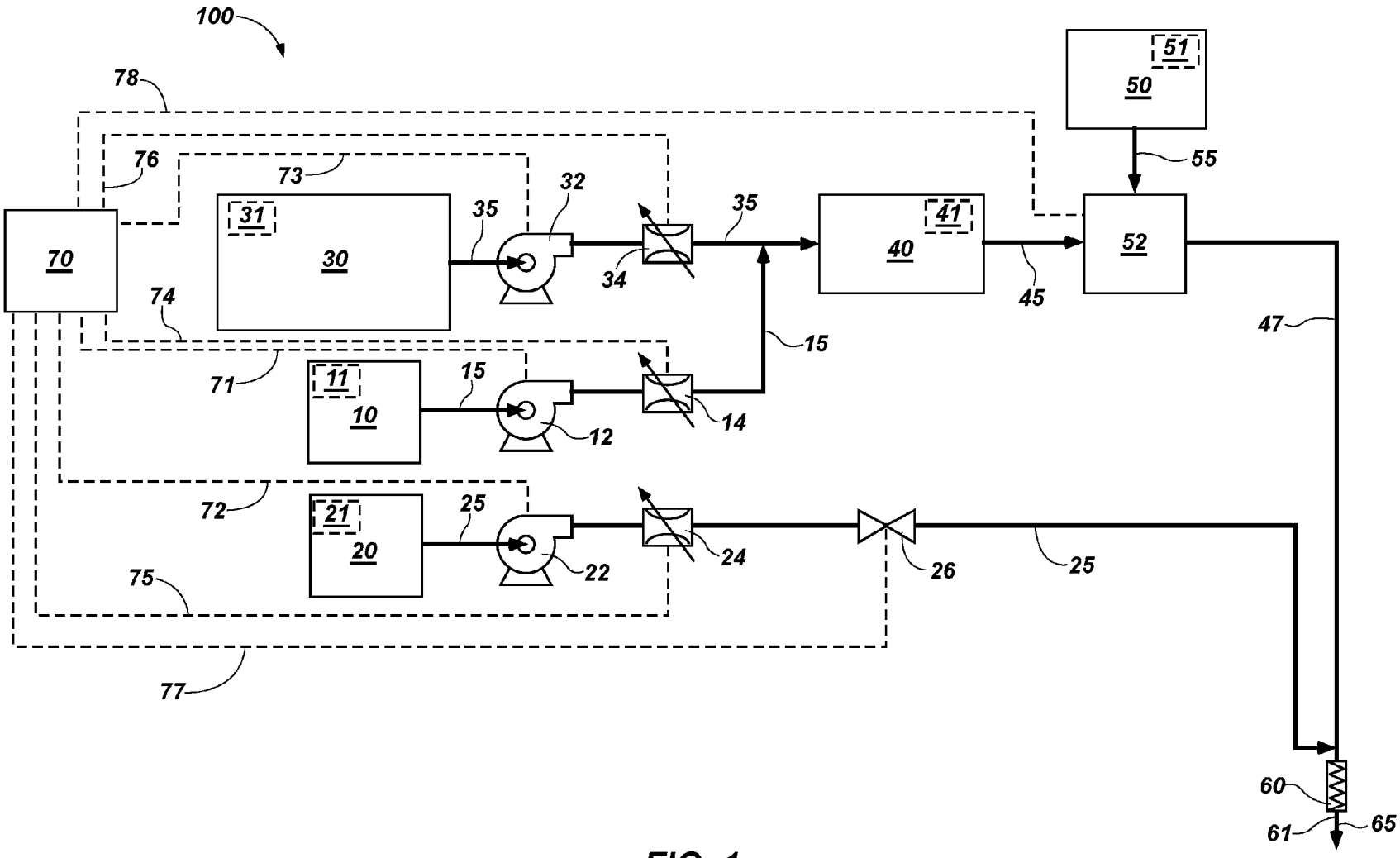
FIG. 1 is a process flow diagram of one embodiment of a system for delivering explosives.

Emulsion explosives are commonly used in the mining, quarrying, and excavation industries for breaking rocks and ore. Generally, a hole, referred to as a "blasthole," is drilled in a surface, such as the ground. Emulsion explosives may then be pumped or augered into the blasthole. Emulsion explosives are generally transported to a job site as an emulsion that is too dense to completely detonate. In general, the emulsion needs to be "sensitized" in order for the emulsion to detonate successfully. Sensitizing is often accomplished by introducing small voids into the emulsion. These voids act as hot spots for propagating detonation.

These voids may be introduced by blowing a gas into the emulsion and thereby forming gas bubbles, adding microspheres, other porous media, and/or injecting chemical gassing agents to react in the emulsion and thereby form gas.

For blastholes, depending upon the length or depth, detonators may be placed at the end, also referred to as the "toe," of the blasthole and at the beginning of the emulsion explosives. Often, in such situations, the top of the blasthole will not be filled with explosives, but will be filled with an inert material, referred to as "stemming," to try and keep the force of an explosion within the material surrounding the blasthole, rather than allowing explosive gases and energy to escape out of the top of the blasthole.

Systems for delivering explosives and methods related thereto are disclosed herein. It will be readily understood that the components of the embodiments as generally described below and illustrated in the Figures herein could be arranged and designed in a wide variety of different configurations. Thus, the following more detailed description of various embodiments, as described below and represented in the Figures, is not intended to limit the scope of the disclosure, but is merely representative of various embodiments. While the various aspects of the embodiments are presented in drawings, the drawings are not necessarily drawn to scale unless specifically indicated.

The phrases "operably connected to," "connected to," and "coupled to" refer to any form of interaction between two or more entities, including mechanical, electrical, magnetic, electromagnetic, fluid, and thermal interaction. Likewise, "fluidically connected to" refers to any form of fluidic interaction between two or more entities. Two entities may interact with each other even though they are not in direct contact with each other. For example, two entities may interact with each other through an intermediate entity.

The term "substantially" is used herein to mean almost and including 100%, including at least about 80%, at least about 90%, at least about 91%, at least about 92%, at least about 93%, at least about 94%, at least about 95%, at least about 96%, at least about 97%, at least about 98%, and at least about 99%.

The term "proximal" is used herein to refer to "near" or "at" the object disclosed. For example, "proximal the outlet of the delivery conduit" refers to near or at the outlet of the delivery conduit.

In some embodiments of an explosives delivery system, the system comprises:

- a first reservoir configured to store a first gassing agent;
- a second reservoir configured to store a second gassing agent;
- a third reservoir configured to store an emulsion matrix;
- a homogenizer configured to mix the emulsion matrix and the first gassing agent into a homogenized product, the homogenizer operably connected to the first reservoir and the third reservoir;
- a delivery conduit operably connected to the homogenizer, wherein the delivery conduit is configured to convey the homogenized product, wherein the delivery conduit is configured for insertion into a blasthole, and wherein the second reservoir is operably connected to the delivery conduit proximal an outlet of the delivery conduit; and
- a mixer located proximal the outlet of the delivery conduit, wherein the mixer is configured to mix the homogenized product with at least the second gassing agent to form a sensitized product.

In some embodiments of methods of delivering explosives, the methods comprise supplying a first gassing agent, supplying a second gassing agent, and supplying an emulsion matrix. The method further comprises inserting a delivery conduit into a blasthole. The method further comprises homogenizing the emulsion matrix and the first gassing agent into a homogenized product, flowing the homogenized product through the delivery conduit, and introducing the second gassing agent proximal an outlet of the delivery conduit. The method further comprises mixing proximal the outlet of the delivery conduit the second gassing agent and the homogenized product to form a sensitized product and conveying the sensitized product to the blasthole.

In some embodiments of methods of varying the explosive energy of explosives in a blasthole, the methods comprise inserting a delivery conduit into a blasthole, and flowing a homogenized product comprising an emulsion matrix through the delivery conduit. The methods further comprise introducing at a first flow rate a gassing agent proximal an outlet of the delivery conduit, mixing the homogenized product with the gassing agent at the first flow rate proximal the outlet of the delivery conduit to form a first sensitized product having a first density, and conveying the first sensitized product into the blasthole. The methods further comprise introducing at a second flow rate the gassing agent proximal the outlet of the delivery conduit, mixing the homogenized product with the gassing agent at the second flow rate proximal the outlet of the delivery conduit to form a second sensitized product having a second density, and conveying the second sensitized product into the blasthole.

FIG. 1 illustrates a process flow diagram of one embodiment of an explosives delivery system 100. The explosives delivery system 100 of FIG. 1 comprises various components and materials as further detailed below. Additionally, any combination of the individual components may comprise an assembly or subassembly for use in connection with an explosives delivery system.

In the embodiments of FIG. 1, explosives delivery system 100 comprises first reservoir 10 configured to store first gassing agent 11, second reservoir 20 configured to store second gassing agent 21, and third reservoir 30 configured to store emulsion matrix 31. Explosives delivery system 100 further comprises homogenizer 40 configured to mix emulsion matrix 31 and first gassing agent 11 into homogenized product 41.

In some embodiments, first gassing agent 11 comprises a pH control agent. The pH control agent may comprise an acid. Examples of acids include, but are not limited to, organic acids such as citric acid, acetic acid, and tartaric acid. Any pH control agent known in the art and compatible with the second gassing agent and gassing accelerator, if present, may be used. The pH control agent may be dissolved in an aqueous solution.

In some embodiments, first reservoir 10 is further configured to store a gassing accelerator mixed with first gassing agent 11. The homogenizer may be configured to mix the emulsion matrix and the mixture of the gassing accelerator and the first gassing agent into the homogenized product. Examples of gassing accelerators include, but are not limited to, thiourea, urea, thiocyanate, iodide, cyanate, acetate, sulphonic acid and its salts, and combinations thereof. Any gassing accelerator known in the art and compatible with the first gassing agent and the second gassing agent may be used. The pH control agent and the gassing accelerator may be dissolved in an aqueous solution.

In some embodiments, second gassing agent 21 comprises a chemical gassing agent configured to react in emulsion matrix 31 and with the gassing accelerator, if present. Examples of chemical gassing agent include, but are not limited to, peroxides such as hydrogen peroxide, inorganic nitrite salts such as sodium nitrite, nitrosamines such as N,N'-dinitrosopentamethylenetetramine, alkali metal borohydrides such as sodium borohydride and bases such as carbonates including sodium carbonate. Any chemical gassing agent known in the art and compatible with emulsion matrix 31 and the gassing accelerator, if present, may be used. The chemical gassing agent may be dissolved in an aqueous solution.

In some embodiments, emulsion matrix 31 comprises a continuous fuel phase and a discontinuous oxidizer phase. Any emulsion matrix known in the art may be used, such as, by way of non-limiting example, Titan® 1000 G from Dyno Nobel.

Examples of the fuel phase include, but are not limited to, liquid fuels such as fuel oil, diesel oil, distillate, furnace oil, kerosene, gasoline, and naphtha; waxes such as microcrystalline wax, paraffin wax, and slack wax; oils such as paraffin oils, benzene, toluene, and xylene oils, asphaltic materials, polymeric oils such as the low molecular weight polymers of olefins, animal oils, such as fish oils, and other mineral, hydrocarbon or fatty oils; and mixtures thereof. Any fuel phase known in the art and compatible with the oxidizer phase and an emulsifier, if present, may be used.

The emulsion matrix may provide at least about 95%, at least about 96%, or at least about 97% of the oxygen content of the sensitized product.

Examples of the oxidizer phase include, but are not limited to, oxygen-releasing salts. Examples of oxygen-releasing salts include, but are not limited to, alkali and alkaline earth metal nitrates, alkali and alkaline earth metal chlorates, alkali and alkaline earth metal perchlorates, ammonium nitrate, ammonium chlorate, ammonium perchlorate, and mixtures thereof, such as a mixture of ammonium nitrate and sodium or calcium nitrates. Any oxidizer phase known in the art and compatible with the fuel phase and an emulsifier, if present, may be used. The oxidizer phase may be dissolved in an aqueous solution, resulting in an emulsion matrix known in the art as a "water-in-oil" emulsion. The oxidizer phase may not be dissolved in an aqueous solution, resulting in an emulsion matrix known in the art as a "melt-in-oil" emulsion.

In some embodiments, emulsion matrix 31 further comprises an emulsifier. Examples of emulsifiers include, but are not limited to, emulsifiers based on the reaction products of poly[alk(en)yl] succinic anhydrides and alkylamines, including the polyisobutylene succinic anhydride (PiBSA) derivatives of alkanolamines. Additional examples of emulsifiers include, but are not limited to, alcohol alkoxylates, phenol alkoxylates, poly(oxyalkylene)glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene) glycol esters, fatty acid amines, fatty acid amide alkoxylates, fatty amines, quaternary amines, alkyloxazolines, alkenyloxazolines, imidazolines, alkylsulphonates, alkylsulphosuccinates, alkylarylsulphonates, alkylphosphates, alkenylphosphates, phosphate esters, lecithin, copolymers of poly(oxyalkylene)glycol and poly(12-hydroxystearic) acid, 2-alkyl and 2-alkenyl-4,4'-bis(hydroxymethyl)oxazoline, sorbitan mono-oleate, sorbitan sesquioleate, 2-oleyl-4,4'bis(hydroxymethyl)oxazoline, and mixtures thereof. Any emulsifier known in the art and compatible with the fuel phase and the oxidizer phase may be used.

Explosives delivery system 100 further comprises first pump 12 configured to pump first gassing agent 11. The inlet of first pump 12 is fluidically connected to first reservoir 10. The outlet of first pump 12 is fluidically connected to first flowmeter 14 configured to measure stream 15 of first gassing agent 11. First flowmeter 14 is fluidically connected to homogenizer 40. Stream 15 of first gassing agent 11 may be introduced into stream 35 of emulsion matrix 31 upstream from homogenizer 40, including before or after third pump 32 or before or after third flowmeter 34. Stream 15 may be introduced along the centerline of stream 35. FIG. 1 illustrates the flow of stream 15 of first gassing agent 11 from first reservoir 10, through first pump 12 and first flowmeter 14, and into homogenizer 40.

Explosives delivery system 100 further comprises second pump 22 configured to pump second gassing agent 21. The inlet of second pump 22 is operably connected to second reservoir 20. The outlet of second pump 22 is fluidically connected to second flowmeter 24 configured to measure the flow of stream 25 of second gassing agent 21. Second flowmeter 24 is fluidically connected to valve 26. Valve 26 is configured to control stream 25 of second gassing agent 21. Valve 26 is fluidically connected to a delivery conduit (not shown) proximal the outlet of the delivery conduit and proximal the inlet of mixer 60. Valve 26 may comprise a control valve. Examples of control valves include, but are not limited to, angle seat valves, globe valves, butterfly valves, and diaphragm valves. Any valve known in the art and compatible with controlling the flow of second gassing agent 21 may be used. FIG. 1 illustrates the flow of stream 25 of second gassing agent 21 from second reservoir 20, through second pump 22, second flowmeter 24, and valve 26, and into stream 47.

Explosives delivery system 100 further comprises third pump 32 configured to pump emulsion matrix 31. The inlet of third pump 32 is fluidically connected to third reservoir 30. The outlet of third pump 32 is fluidically connected to third flowmeter 34 configured to measure stream 35 of emulsion matrix 31. Third flowmeter 34 is fluidically connected to homogenizer 40. FIG. 1 illustrates the flow of stream 35 of emulsion matrix 31 from third reservoir 30, through third pump 32 and third flowmeter 34, and into homogenizer 40.

In some embodiments, explosives delivery system 100 is configured to convey second gassing agent 21 at a mass flow rate of less than about 5%, less than about 4%, less than about 2%, or less than about 1% of a mass flow rate of emulsion matrix 31.

Homogenizer 40 may be configured to homogenize emulsion matrix 31 when forming homogenized product 41. As used herein, "homogenize" or "homogenizing" refers to reducing the size of oxidizer phase droplets in the fuel phase of an emulsion matrix, such as emulsion matrix 31. Homogenizing emulsion matrix 31 increases the viscosity of homogenized product 41 as compared to emulsion matrix 31. Homogenizer 40 may also be configured to mix stream 35 of emulsion matrix 31 and stream 15 of first gassing agent 11 into homogenized product 41. Stream 45 of homogenized product 41 exits homogenizer 40. Pressure from stream 35 and stream 15 may supply the pressure for flowing stream 45.

Homogenizer 40 may reduce the size of oxidizer phase droplets by introducing a shearing stress on emulsion matrix 31 and first gassing agent 11. Homogenizer 40 may comprise a valve configured to introduce a shearing stress on emulsion matrix 31 and first gassing agent 11. Homogenizer 40 may further comprise mixing elements, such as, by way of non-limiting example, static mixers and/or dynamic mixers, such as augers, for mixing stream 15 of first gassing agent 11 with stream 35 of emulsion matrix 31.

Homogenizing emulsion matrix 31 when forming homogenized product 41 may be beneficial for sensitized product 61. For example, the reduced oxidizer phase droplet size and increased viscosity of sensitized product 61, as compared to an unhomogenized sensitized product, may mitigate gas bubble coalescence of the gas bubbles generated by introduction of second gassing agent 21. Likewise, the effects of static head pressure on gas bubble density in a homogenized sensitized product 61 are reduced as compared to an unhomogenized sensitized product. Therefore, gas bubble migration is less in homogenized sensitized product 61 as compared to an unhomogenized sensitized product. As a result, the as-loaded density of homogenized sensitized product 61 at a particular depth of a blasthole is closer to the conveyed density of the homogenized sensitized product 61 at that depth than would be the case for the as-loaded density of an unhomogenized sensitized product conveyed instead. The increased viscosity of homogenized sensitized product 61 also tends to reduce migration of the product into cracks and voids in the surrounding material of a blasthole, as compared to an unhomogenized sensitized product.

In some embodiments, homogenizer 40 does not substantially homogenize emulsion matrix 31. In such embodiments, homogenizer 40 comprises elements primarily configured to mix stream 35 and stream 15, but does not include elements primarily configured to reduce the size of oxidizer phase droplets in emulsion matrix 31. In such embodiments, sensitized product 61 would be an unhomogenized sensitized product. "Primarily configured" as used herein refers to the main function that an element was configured to perform. For example, any mixing element(s) of homogenizer 40 may have some effect on oxidizer phase droplet size, but the main function of the mixing elements may be to mix stream 15 and stream 35.

Explosives delivery system 100 further comprises fourth reservoir 50 configured to store lubricant 51 and lubricant injector 52 configured to lubricate conveyance of homogenized product 41 through the inside of the delivery conduit. Fourth reservoir 50 is fluidically connected to lubricant injector 52. Lubricant injector 52 may be configured to inject an annulus of lubricant 51 that surrounds stream 45 of homogenized product 41 and lubricates flow of homogenized product inside the delivery conduit. Lubricant 51 may comprise water. Homogenizer 40 is fluidically connected to lubricant injector 52. Lubricant injector 52 is operably connected to the delivery conduit. Stream 45 of homogenized product 41 enters lubricant injector 52. Stream 55 of lubricant 51 exits fourth reservoir 50 and is introduced by lubricant injector 52 to stream 45. Stream 55 may be injected as an annulus that substantially radially surrounds stream 45. Stream 47 exits lubricant injector 52 and comprises stream 45 substantially radially surrounded by stream 55. Stream 55 of lubricant 51 lubricates the flow of stream 45 through the delivery conduit.

Explosives delivery system 100 further comprises a delivery conduit. The delivery conduit is operably connected to the lubricant injector. The delivery conduit is configured to convey stream 47 to mixer 60. The delivery conduit is configured for insertion into a blasthole.

Explosives delivery system 100 further comprises mixer 60 located proximal the outlet of the delivery conduit. Mixer 60 is configured to mix homogenized product 41 and lubricant 51 in stream 47 with second gassing agent 21 in stream 25 to form sensitized product 61 in stream 65. The mixer may comprise a static mixer. An example of a static mixer includes, but is not limited to, a helical static mixer. Any static mixer known in the art and compatible with mixing second gassing agent 21, homogenized product 41, and lubricant 51 may be used.

In some embodiments, stream 15 of first gassing agent 11 is not introduced to stream 35 upstream from homogenizer 40. Instead, stream 15 of first gassing agent 11 may be introduced to stream 45 of homogenized product 41 after homogenizer 40 or into stream 47 after lubricant injector 52. Stream 15 may be injected along the centerline of stream 45 or stream 47. In these embodiments, first gassing agent 11 of stream 15 may be mixed with homogenized product 41 and second gassing agent 25 at mixer 60.

Explosives delivery system 100 further comprises control system 70 configured to vary the flow rate of stream 25 relative to the flow rate of stream 47. Control system 70 may be configured to vary the flow rate of stream 25 while sensitized product 61 is continuously formed and conveyed to the blasthole. Control system 70 may be configured to vary the flow rate of stream 25 while also varying the flow rate of stream 15, stream 35, and stream 55 to change the flow rate of stream 47.

Control system 70 may be configured to automatically vary the flow rate of stream 25 as the blasthole is filled with sensitized product 61, depending upon a desired sensitized product density of sensitized product 61 at a particular depth of the blasthole. Control system 70 may be configured to determine the desired sensitized product density based upon a desired explosive energy profile within the blasthole. Control system 70 may be configured to adjust the flow rate of stream 15 of first gassing agent 11 based on the temperature of emulsion matrix 31 and the desired reaction rate of second gassing agent 21 in homogenized product 41. The temperature of emulsion matrix 31 may be measured in third reservoir 30. Control system 70 may be configured to vary the flow rate of stream 25 to maintain a desired sensitized product density based, at least in part, on variations in the flow rate of stream 35 to homogenizer 40.

Control system 70 comprises a computer (not shown) comprising a processor (not shown) operably connected to a memory device (not shown). The memory device stores programming for accomplishing desired functions of control system 70 and the processor implements the programming. Control system 70 communicates with first pump 12 via communication system 71. Control system 70 communicates with second pump 22 via communication system 72. Control system 70 communicates with third pump 32 via communication system 73. Control system 70 communicates with first flowmeter 14 via communication system 74. Control system 70 communicates with second flowmeter 24 via communication system 75. Control system 70 communicates with third flowmeter 34 via communication system 76. Control system 70 communicates with valve 26 via communication system 77. Control system 70 communicates with lubricant injector 52 via communication system 78. Communication systems 71, 72, 73, 74, 75, 76, 77, and 78 may comprise one or more wires and/or wireless communication systems.

In some embodiments, explosives delivery system 100 is configured for delivering a blend of sensitized product 61 with solid oxidizers and additional liquid fuels. In such embodiments, the delivery conduit may not be inserted into the blasthole, but instead sensitized product 61 may be blended with solid oxidizer and additional liquid fuel. The resulting blend may be poured into a blasthole, such as from the discharge of an auger chute located over the mouth of a blasthole.

For example, explosives delivery system 100 may comprise a fifth reservoir configured to store the solid oxidizer. Explosives delivery system 100 may further comprise a sixth reservoir configured to store an additional liquid fuel, separate from the liquid fuel that is part of emulsion matrix 31. A hopper may operably connect the fifth reservoir to a mixing element, such as an auger. The mixing element may be fluidically connected to the sixth reservoir. The mixing element may also be fluidically connected to the outlet of the delivery conduit configured to form sensitized product 61. The mixing element may be configured to blend sensitized product 61 with the solid oxidizer of the fifth reservoir and the liquid fuel of the sixth reservoir. A chute may be connected to the discharge of the mixing element and configured to convey blended sensitized product 61 to a blasthole. For example, sensitized product 61 may be blended in an auger with ammonium nitrate and No. 2 fuel oil to form a "heavy ANFO" blend.

Explosives delivery system 100 may comprise additional reservoirs for storing solid sensitizers and/or energy increasing agents. These additional components may be mixed with the solid oxidizer of the fifth reservoir or may be mixed directly with homogenized product 41 or sensitized product 61. In some embodiments, the solid oxidizer, the solid sensitizer, and/or the energy increasing agent may be blended with sensitized product 61 without the addition of any liquid fuel from the sixth reservoir.

Examples of solid sensitizers include, but are not limited to, glass or hydrocarbon microballoons, cellulosic bulking agents, expanded mineral bulking agents, and the like. Examples of energy increasing agents include, but are not limited to, metal powders, such as aluminum powder. Examples of the solid oxidizer include, but are not limited to, oxygen-releasing salts formed into porous spheres, also known in the art as "prills." Examples of oxygen-releasing salts are those disclosed above regarding the oxidizer phase of emulsion matrix 31. Prills of the oxygen-releasing salts may be used as the solid oxidizer. Any solid oxidizer known in the art and compatible with the liquid fuel may be used. Examples of the liquid fuel are those disclosed above regarding the fuel phase of emulsion matrix 31. Any liquid fuel known in the art and compatible with the solid oxidizer may be used.

It should be understood that explosives delivery system 100 may further comprise additional components compatible with delivering explosives.

It should be understood that explosives delivery system 100 may be modified to exclude components not necessary for flowing streams 15, 25, 35, and 45. For example, lubricant injector 52 and fourth reservoir 50 may not be present. In another example, one or more of first pump 12, second pump 22, third pump 32, first flowmeter 14, second flowmeter 24, and third flowmeter 34 may not be present. For example, instead of first pump 12 being present, explosives delivery system 100 may rely upon the pressure head in first reservoir 10 to supply sufficient pressure for flow of stream 15 of first gassing agent 11. In another example, control system 70 may not be present and instead manual controls may be present for controlling the flow of streams 15, 25, 35, and 45.

It should further be understood that FIG. 1 is a process flow diagram and does not dictate physical location of any of the components. For example, third pump 32 may be located internally within third reservoir 30.

Figure 2:
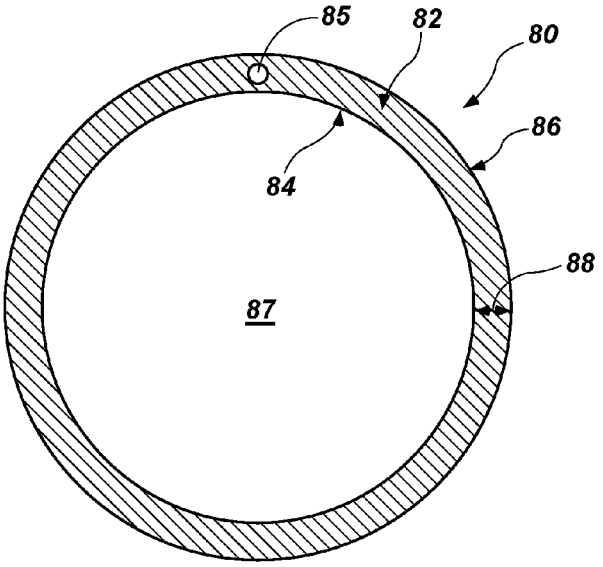
FIG. 2 illustrates a cross-sectional slice of one embodiment of a delivery conduit.

FIG. 2 illustrates a cross-sectional slice of one embodiment of delivery conduit 80 usable with explosives delivery system 100. In this embodiment, delivery conduit 80 comprises flexible tube 82. Flexible tube 82 comprises first annulus 87 comprising inner surface 84 and outer surface 86. Inner surface 84 is separated from outer surface 86 by first thickness 88. First annulus 87 is configured to convey stream 47 comprising stream 45 of homogenized product 41 and stream 55 of lubricant 51.

In these embodiments, flexible tube 82 further comprises second annulus 85 longitudinally parallel to first annulus 87 and radially offset from first annulus 87. Second annulus 85 is radially located, relative to the center of first annulus 87, between inner surface 84 and outer surface 86. The diameter of second annulus 85 is less than the length of first thickness 88. Second annulus 85 is configured to convey stream 25 comprising second gassing agent 21. The longitudinal length of second annulus 85 may be substantially equal to the longitudinal length of first annulus 87.

In FIG. 2, second annulus 85 results in a separate tube within the sidewall of the flexible tube 82. In an alternative embodiment, a separate tube may be located external to flexible tube 82 for conveying stream 25 of second gassing agent 21. For example, the separate tube may be attached to outer surface 86 of flexible tube 82. Further alternatively, the separate tube may be located internal to flexible tube 82, such as attached to inner surface 84.

Figure 3:
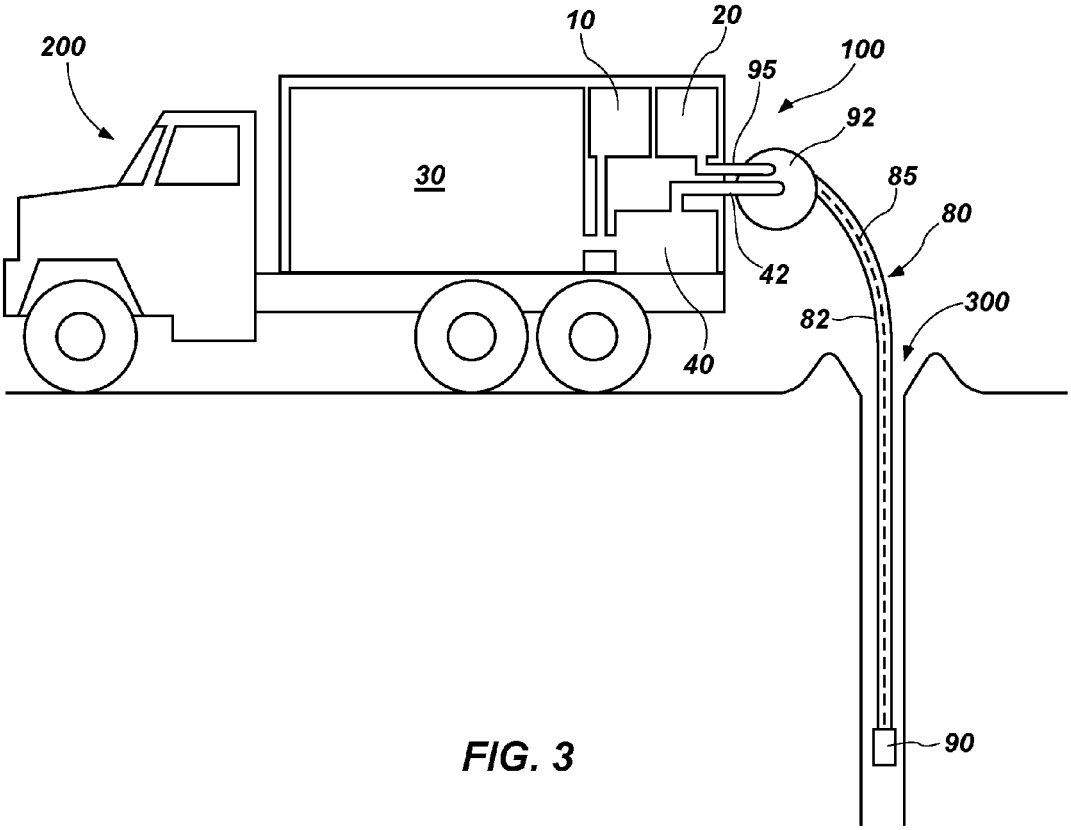
FIG. 3 illustrates a sideview of one embodiment of a truck equipped with particular embodiments of the system of FIG. 1, with the delivery conduit inserted into a blasthole.

FIG. 3 illustrates a sideview of one embodiment of truck 200 equipped with particular embodiments of explosives delivery system 100. FIG. 3 presents a simplified truck 200 and does not illustrate all of the components of explosives delivery system 100 of FIG. 1. FIG. 3 illustrates first reservoir 10, second reservoir 20, third reservoir 30, and homogenizer 40 mounted on truck 200. Truck 200 is positioned near vertical blasthole 300. Delivery conduit 80 is unwound from hose reel 92 and inserted into vertical blasthole 300. Conduit 42 fluidically connects homogenizer 40 to first annulus 87 (not shown) inside delivery conduit 80. Conduit 95 fluidically connects second reservoir 20 to second annulus 85 (shown in phantom) of delivery conduit 80. Conduit 95 is fluidically separated from homogenizer 40.

FIG. 3 illustrates nozzle 90 connected at the end of delivery conduit 80. Nozzle 90 is configured to convey stream 65 of sensitized product 61 to blasthole 300. Nozzle 90 may include mixer 60 (not shown) within an inner surface of nozzle 90. The inner surface of nozzle 90 may be mated with inner surface 84 of first annulus 87. Nozzle 90 may comprise at least one port configured for introducing stream 25 of second gassing agent 21 into stream 47 comprising homogenized product 41. The at least one port may connect the outer surface and the inner surface of the nozzle. The outlet of second annulus 85 of flexible tube 82 may be operably connected to the outer surface of nozzle 90 and the at least one port. The outer surface of nozzle 90 may comprise a channel for fluidically connecting the outlet of second annulus 85 to the at least one port of nozzle 90. The at least one port may be located upstream from mixer 60 within nozzle 90.

Figure 4:
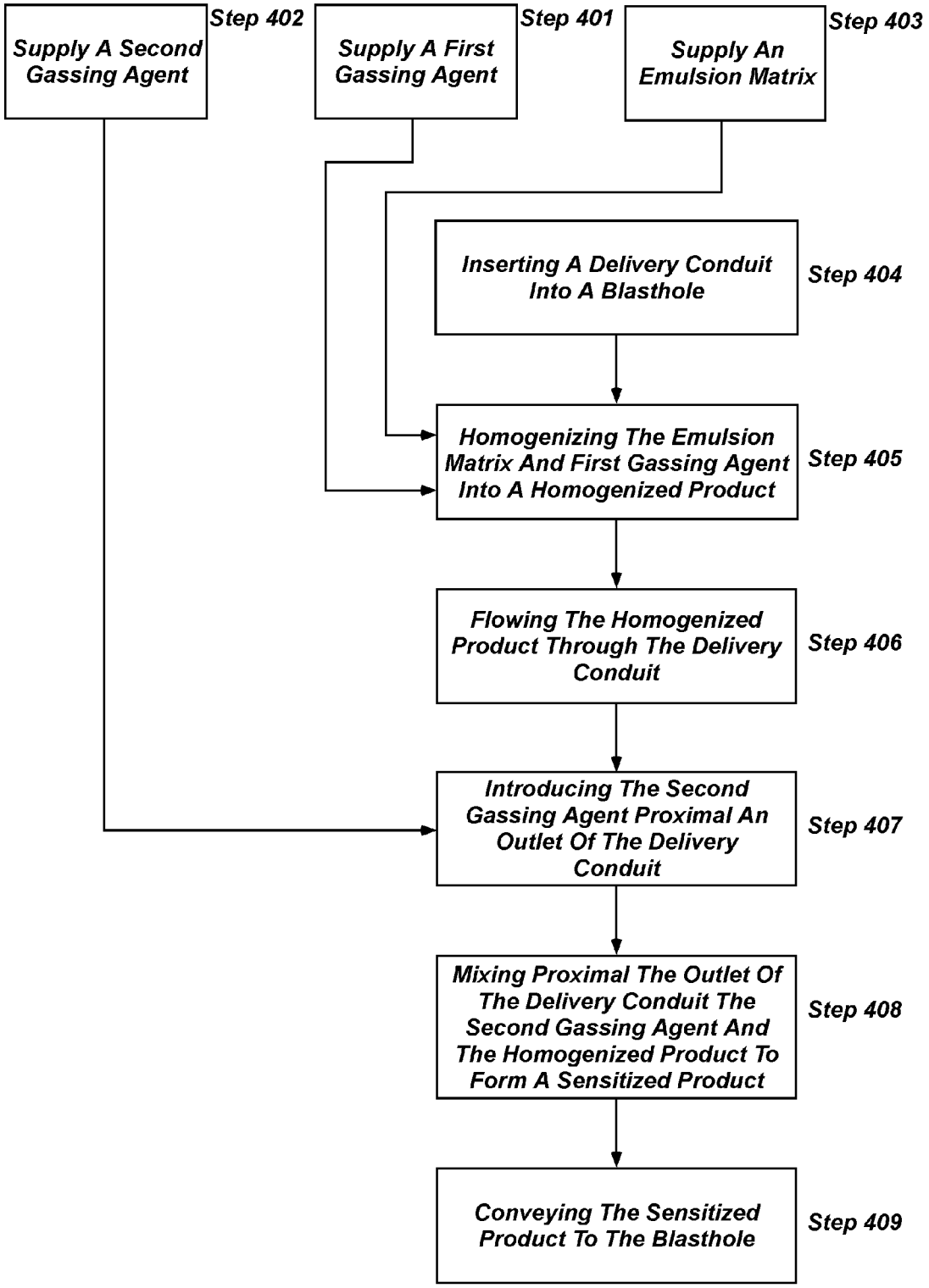
FIG. 4 is a flow chart of one embodiment of a method of delivering explosives.

FIG. 4 is a flow chart of one embodiment of a method of delivering explosives. In these embodiments, the method comprises supplying, Step 401, a first gassing agent; supplying, Step 402, a second gassing agent; and supplying, Step 403, an emulsion matrix. The method further comprises inserting, Step 404, a delivery conduit into a blasthole. The method further comprises homogenizing, Step 405, the emulsion matrix and the first gassing agent into a homogenized product; flowing, Step 406, the homogenized product through the delivery conduit; and introducing, Step 407, the second gassing agent proximal an outlet of the delivery conduit. The method further comprises mixing, Step 408, proximal the outlet of the delivery conduit the second gassing agent and the homogenized product to form a sensitized product; and conveying, Step 409, the sensitized product to the blasthole.

In some embodiments, the method may further comprise varying a flow rate of the second gassing agent relative to a flow rate of the homogenized product. The methods may further comprise varying the flow rate of the second gassing agent while the sensitized product is continuously formed and conveyed to the blasthole. The methods may further comprise automatically varying the flow rate of the second gassing agent as the blasthole is filled with sensitized product, depending upon a desired sensitized product density at a particular depth of the blasthole. The methods may further comprise determining a flow rate of the second gassing agent that will result in a desired sensitized product density based, at least in part, on a flow rate of the emulsion matrix to the homogenizer. The methods may further comprise selecting several different desired sensitized product densities.

In some embodiments, homogenizing the emulsion matrix and the first gassing agent into a homogenized product comprises first homogenizing the emulsion matrix and then mixing the first gassing agent with the homogenized emulsion matrix.

In some embodiments, the blastholes may comprise vertical blastholes. The blastholes may be formed in the surface of earth or the blastholes may be formed underground.

Figure 5:
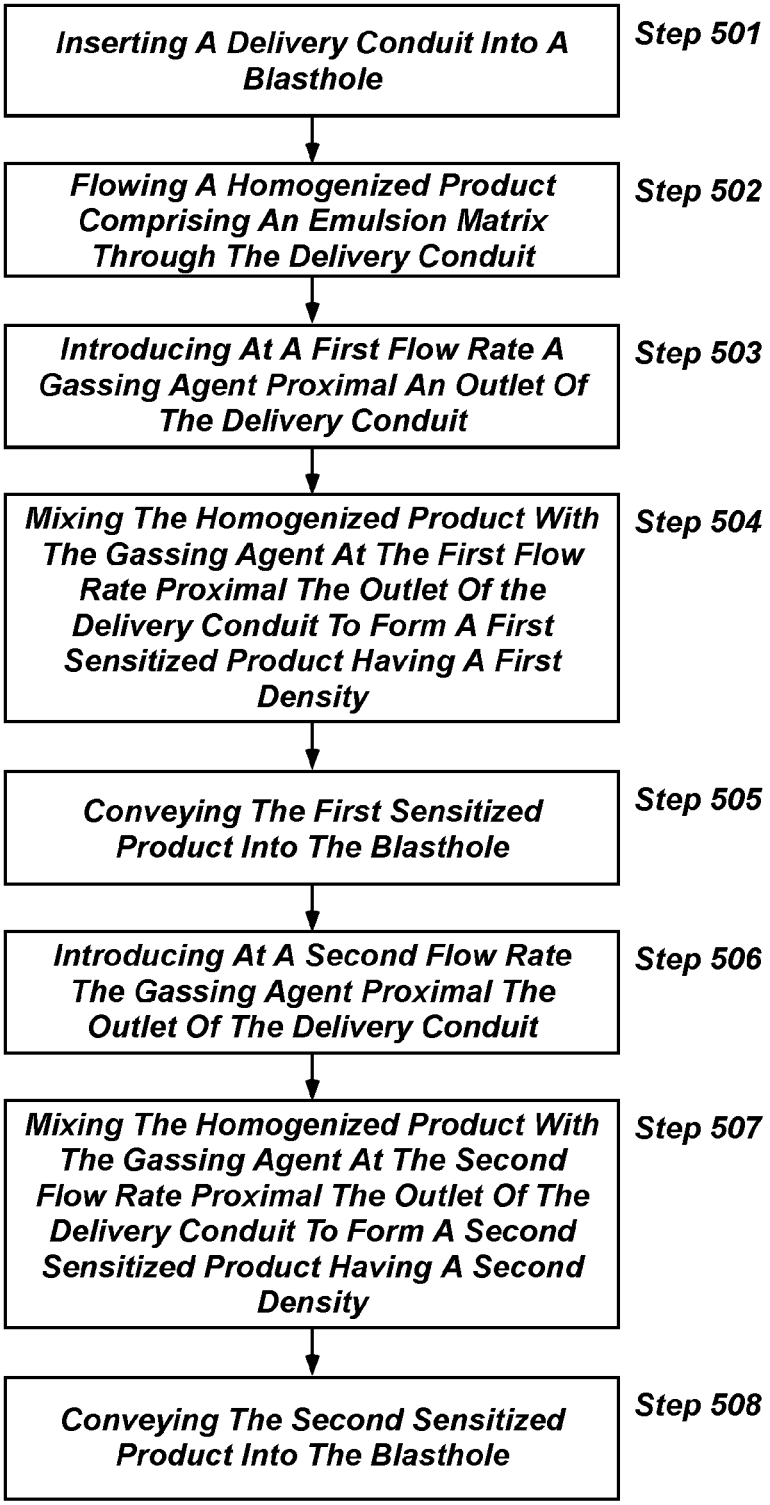
FIG. 5 is a flow chart of one embodiment of a method of varying the explosive energy of explosives in a blasthole.

FIG. 5 is a flow chart of some embodiments of methods of varying the explosive energy of explosives in a blasthole. In these embodiments, the methods comprise inserting, Step 501, a delivery conduit into a blasthole, and flowing, Step 502, a homogenized product comprising an emulsion matrix through the delivery conduit. The methods further comprise introducing, Step 503, at a first flow rate a gassing agent proximal an outlet of the delivery conduit; mixing, Step 504, the homogenized product with the gassing agent at the first flow rate proximal the outlet of the delivery conduit to form a first sensitized product having a first density; and conveying, Step 505, the first sensitized product into the blasthole. The methods further comprise introducing, Step 506, at a second flow rate the gassing agent proximal the outlet of the delivery conduit; mixing, Step 507, the homogenized product with the gassing agent at the second flow rate proximal the outlet of the delivery conduit to form a second sensitized product having a second density; and conveying, Step 508, the second sensitized product into the blasthole.

In some embodiments, the gassing agent introduced proximal the outlet of the delivery conduit may comprise a second gassing agent and the homogenized product may comprise an emulsion matrix mixed with a first gassing agent. The homogenized product may comprise a homogenized emulsion matrix.

In some embodiments, the homogenized product is continuously flowed through the delivery conduit at a constant flow rate while the first flow rate of the gassing agent is varied to the second flow rate of the gassing agent.

In some embodiments, the methods further comprise introducing at a third flow rate the gassing agent proximal the outlet of the delivery conduit; mixing the homogenized product with the gassing agent at the third flow rate proximal the outlet of the delivery conduit to form a third sensitized product having a third density; and conveying the third sensitized product into the blasthole.

In some embodiments, the methods further comprise introducing at a fourth flow rate the gassing agent proximal the outlet of the delivery conduit; mixing the homogenized product with the gassing agent at the fourth flow rate proximal the outlet of the delivery conduit to form a fourth sensitized product having a fourth density; and conveying the fourth sensitized product into the blasthole.

In some embodiments, the methods comprise continuously flowing the homogenized product through the delivery conduit while the flow rate of the gassing agent is continuously varied or is varied as often as is desired to form sensitized products having desired densities at different locations along the blasthole. Alternatively, the homogenized product may be continuously flowed through the delivery conduit at variable flow rates.

In some embodiments, the methods further comprise determining rock and/or ore properties along the length or depth of the blasthole. Examples of rock and/or ore properties include, but are not limited to, solid density, unconfined compressive strength, Young's modulus, and Poisson's ratio. Methods of determining rock and/or ore properties are known in the art and, thus, are not disclosed herein. Knowledge of the rock and/or ore properties may be used by one skilled in the art to vary the density of the sensitized product along the length or depth of the blasthole to achieve optimum performance of the explosive.

In some embodiments, the methods further comprise determining a desired explosive energy profile within the blasthole and then determining a desired sensitized product density profile capable of delivering the desired explosive energy profile.

Figure 6:
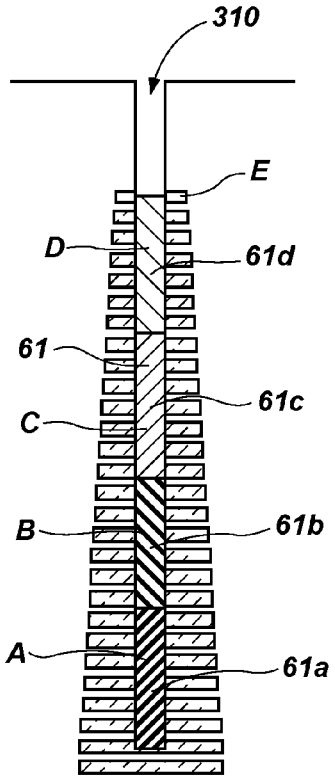
FIG. 6 illustrates a blasthole filled according to one embodiment of the method illustrated in FIG. 5.

FIG. 6 illustrates a cross-section of vertical blasthole 310 filled with sensitized product 61 comprising first sensitized product 61*a* conveyed at a first density A, second sensitized product 61*b* conveyed at a second density B, third sensitized product 61*c* conveyed at a third density C, and fourth sensitized product 61*d* conveyed at a fourth density D. It should be understood that sensitized product 61 may further comprise additional segments conveyed at different densities. It should also be understood that the density of sensitized product 61 may be continuously varied. In FIG. 6, first density A is greater than second density B, which is greater than third density C, which is greater than fourth density D.

FIG. 6 illustrates the relative explosive energy distribution along blasthole 310 with bar graph E on either side of blasthole 310. Even though sensitized product 61 is illustrated with four different conveyed densities, the relative explosive energy distribution, in the illustrated embodiment, gradually changes from the top of sensitized product 61 to the bottom of sensitized product 61. As discussed above, the as-loaded density of homogenized sensitized product 61 at a particular depth of a blasthole is closer to the conveyed density of the homogenized sensitized product 61 at that depth than would be the case for the as-loaded density of an unhomogenized sensitized product conveyed instead. In general, explosive energy correlates with the density of conveyed sensitized product 61. As the density of conveyed homogenized sensitized product 61 decreases the explosive energy also decreases.

The amount of gassing agent introduced to the homogenized product determines the sensitivity and density of the sensitized product. Therefore, varying the flow rate of the gassing agent controls the density of the sensitized product. For example, an increased flow of the second gassing agent increases the amount of gas bubbles. The increased gas bubbles increase the sensitivity to detonation and decrease the density, thereby decreasing the explosive energy of the sensitized product. By comparison, a decreased flow of the gassing agent decreases the amount of gas bubbles. The decreased number of gas bubbles decreases the sensitivity to detonation and increases the density, thereby increasing the explosive energy of the sensitized product.

FIG. 6 illustrates an explosive energy profile that is roughly pyramidal in shape. It should be understood that the disclosed methods of varying the explosive energy of explosives in a blasthole may be used to implement any number of desired explosive energy profiles of the sensitized product. For example, with a vertical blasthole, it may be desirable to have first density A be less than fourth density D. In that scenario, bar graph E of the relative explosive energy may look more like an inverted pyramid. In another example, it may be desirable to have second density B and/or third density C be greater than fourth density D. In that scenario, bar graph E of the relative explosive energy may have a convex shape on either side of vertical blasthole 310.

In some embodiments, the methods of varying the explosive energy in a blasthole further comprises increasing the diameter of the blasthole in regions of the blasthole where increased explosive energy is desired. Increasing the diameter in a region of the blasthole allows for an increased volume of explosives to be placed in that region as compared to other regions of the blasthole. Additionally, the density of the sensitized product conveyed can be increased at that region by controlling the flow rate of the gassing agent (e.g., the second gassing agent) as the sensitized product is conveyed to that region of the blasthole. Thus, not only is the explosive energy increased by the increased density of the explosives, but the explosive energy is increased by the increased volume of the explosives.

Figure 7:
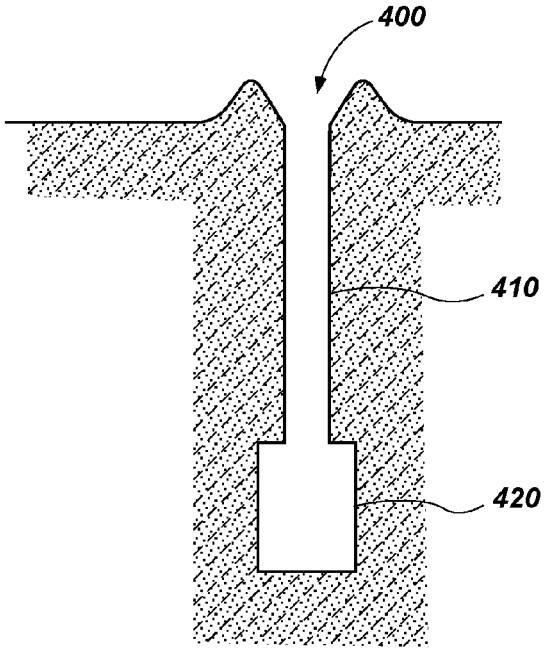
FIG. 7 illustrates one embodiment of a variable diameter blasthole for use with the methods disclosed herein, such as those illustrated in FIGS. 4 and 5.

FIG. 7 illustrates one embodiment of a blasthole 400 with variable diameters. In this embodiment, first region 410 has a first diameter and second region 420 has a second diameter that is greater than the first diameter. In FIG. 7, second region 420 is at the toe of blasthole 400. However, it should be understood that the diameter of blasthole 400 may be increased in any region of the blasthole where an increased relative volume of explosives is desired. For example, for quarry blasting, if a seam of hard rock exists twenty-five meters below the surface of the ground with an additional twenty-five meters of softer rock extending below the seam of hard rock, then the second region 420 may be formed halfway down a fifty meter deep blasthole. In that example, first region 410 would extend above and below second region 420.

Additionally, there may be multiple regions of increased diameter. For example, in surface coal mining, a hard rock seam may exist above a coal seam. However, between that hard rock seam and the surface may be an additional hard rock seam. Therefore, in that example, blasthole 400 may include a second region 420 at the toe of blasthole 400 and also a second region 420 at the corresponding depth of the additional hard rock seam. In that example, first region 410 would extend between the two second regions 420 and also above the upper second region 420.

The length of the second region 420 may correspond to the length of the blasthole for which increased explosive energy is desired. Thus, in embodiments with multiple second regions 420, the length of each individual second region 420 may be different from each other, depending on the topology along the length of blasthole 400.

Disclosed herein are methods of increasing the diameter of only a particular region of a blasthole. For example, blasthole 400 may be drilled to have the diameter of first region 410 along the entire length of blasthole 400. Next, an underreamer may be inserted into blasthole 400. At the top of second region 420, the underreamer may be actuated and the diameter of blasthole 400 increased along the desired length of second region 420. After second region 420 is formed, the underreamer may be deactivated and removed from blasthole 400 without changing the diameter of first region 410.

Exemplary underreaming technology may include drill bits mounted on hydraulically-actuated arms. When the arms are not hydraulically-actuated, the arms are collapsed together in cylindrical fashion. With the arms collapsed, the underreamer may be moved in and out of the blasthole without modifying the diameter of the blasthole. The underreamer may be selectively actuated to form wider diameter regions as desired. Additionally, the amount of hydraulic pressure applied to the arms may determine the diameter of the hole created by the underreamer.

It should be understood that an any variable diameter drilling technology known in the art may be used. Additionally, it should be understood that the methods of increasing the diameter of only a particular region of a blasthole may also be used with the method of delivering explosives disclosed herein, such as the method illustrated in FIG. 4.

It should be understood that explosives delivery system 100 may be used to perform the steps of the methods illustrated in FIGS. 4 and 5.

One benefit from introducing the gassing agent, such as second gassing agent 21, proximal the outlet of the delivery conduit is that the density of the sensitized product may be almost instantly changed as different densities are desired. This provides an operator with precise control over the density of the conveyed sensitized product. Therefore, an operator can fill a blasthole with sensitized product that closely matches the desired density profile for the blasthole. That in turn has the benefit, that upon detonation, the resulting explosion may achieve the desired results. The ability to achieve desired explosive results may help achieve environmental goals and reduce overall costs associated with a blasting project.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art, and having the benefit of this disclosure, that changes may be made to the details of the above-described embodiments without departing from the underlying principles of the disclosure herein.

The invention claimed is:

1. A method for varying the explosive energy of explosives delivered to a blasthole, the method comprising:

determining rock and/or ore properties along a length or depth of a blasthole;

mixing a gassing agent with an emulsion matrix proximal an outlet of a delivery conduit at different discrete, uniform flow rates to form a sensitized emulsion explosive for flowing into the blasthole according to a blasthole explosive density profile with a desired density in discrete segments of the blasthole, based on the rock and/or ore properties along the length or depth of the blasthole; and loading the blasthole with the sensitized emulsion explosive according to the blasthole explosive density profile in discrete segments each having a substantially uniform density along the length of the segment.

2. The method of claim 1, wherein mixing the gassing agent with the emulsion matrix occurs proximal the outlet of the delivery conduit inserted into the blasthole.

3. The method of claim 1, wherein the gassing agent comprises a chemical gassing agent.

4. The method of claim 1, further comprising determining the blasthole explosive density profile with the desired density in discrete segments having substantially uniform density along the length of each segment.

5. The method of claim 1, wherein the gassing agent is mixed at two different flow rates to provide two different desired densities along the length or depth of the blasthole, the gassing agent is mixed at three different flow rates to provide three different desired densities along the length or depth of the blasthole, the gassing agent is mixed at four different flow rates to provide the blasthole explosive density profile comprises four different desired densities along the length or depth of the blasthole, the gassing agent is mixed at five different flow rates to provide the blasthole explosive density profile comprises five different desired densities along the length or depth of the blasthole, or the gassing agent is mixed at six different flow rates to provide the blasthole explosive density profile comprises six different desired densities along the length or depth of the blasthole.

6. The method of claim 1, further comprising receiving the blasthole explosive density profile with the desired density in discrete segments of the blasthole.

7. The method of claim 1, further comprising calculating flow rates of a gassing agent that, upon mixing the gassing agent with an emulsion matrix to form a sensitized emulsion explosive for flowing into the blasthole, will achieve the blasthole explosive density profile.

8. The method of claim 1, further comprising determining the blasthole explosive density profile with the desired density in discrete segments of the blasthole.

9. The method of claim 1, further comprising determining a blasthole explosive energy profile with a desired energy in discrete segments of the blasthole and then determining the blasthole explosive density profile capable of delivery the blasthole explosive energy profile.

10. The method of claim 1, further comprising calculating flow rates of a pH control agent, that upon mixing the pH control agent and the chemical gassing agent with the emulsion matrix flowing into the blasthole will achieve the blasthole explosive density profile.

11. The method of claim 10, further comprising calculating flow rates of an accelerator, that upon mixing the accelerator, the pH control agent, and the chemical gassing agent with the emulsion matrix flowing into the blasthole, will achieve the blasthole explosive density profile.

12. The method of claim 1, further comprising calculating when to change flow rates of the gassing agent based upon filling a desired portion of the blasthole with sensitized emulsion explosive of a particular density.

13. The method of claim 1, wherein the blasthole explosive density profile includes regions of increased diameter in the blasthole.

14. A method for varying the explosive energy of explosives delivered to a blasthole, the method comprising:

mixing a gassing agent with an emulsion matrix at different discrete, uniform flow rates to form a sensitized emulsion explosive for flowing into a blasthole according to a blasthole explosive energy profile with a desired energy in discrete segments based on rock and/or ore properties along the length or depth of the blasthole; and loading the blasthole with the sensitized emulsion explosive according to the blasthole explosive energy profile in discrete segments having a substantially uniform density along the length of a segment.

15. The method of claim 14, wherein mixing the gassing agent with the emulsion matrix occurs proximal an outlet of a delivery conduit inserted into the blasthole.

16. The method of claim 14, further comprising receiving, determining, and/or storing a blasthole explosive density profile with a desired density in discrete segments of the blasthole.

17. The method of claim 14, further comprising receiving, determining, and/or storing the blasthole explosive energy profile with the desired energy in discrete segments of the blasthole.

18. The method of claim 14, further comprising determining rock and/or ore properties along a length or depth of the blasthole.

* * * * *